US005108329A

United States Patent [19]

Loxterman

[11] Patent Number: 5,108,329

[45] Date of Patent: Apr. 28, 1992

[54] SLALOM WATER SKI

[76] Inventor: Albert F. Loxterman, 123 Greeley St., Buffalo, N.Y. 14207

[21] Appl. No.: 624,637

[22] Filed: Dec. 10, 1990

[51] Int. Cl.[5] ..... B63B 35/81

[52] U.S. Cl. ..... 441/79; 441/68

[58] Field of Search ..... 441/68, 70, 71, 79

[56] References Cited

U.S. PATENT DOCUMENTS

| | | | |
|---|---|---|---|
| 2,716,246 | 8/1955 | Billingham | 441/70 |
| 3,052,899 | 9/1962 | Antoine | 441/71 |
| 3,066,327 | 12/1962 | Durfey | 9/310 |
| 3,096,530 | 7/1963 | Almgren | 441/70 |
| 3,599,259 | 8/1971 | Shewman | 441/70 |
| 3,655,211 | 4/1972 | Bollettieri | 280/11.135 |
| 4,262,927 | 4/1981 | Hochstrasser | 280/L09 |
| 4,568,296 | 2/1986 | Newell | 441/70 |
| 4,604,070 | 8/1986 | McKee et al. | 441/70 |
| 4,697,821 | 10/1987 | Hayaski et al. | 280/609 |
| 4,838,572 | 6/1989 | Diard et al. | 441/68 |

*Primary Examiner*—Sherman Basinger
*Assistant Examiner*—Thomas J. Brahan
*Attorney, Agent, or Firm*—Wallace F. Neyerlin

[57] ABSTRACT

The top surface of the rear end of a slalom water ski is modified by adding a special contour to same to improve its performance in racing competition. The modification relates to adding a "hump" or "hummock" on the rear one-third of the ski. The sides of the hump coincide with the sides of the rear of the ski and the curvature at the back of the "hump" just matches the contour of the back end of the ski. Also in this hump, the standard seven degree angle from vertical of a standard ski continues upwardly for a given distance above the normal top surface of the ski and is then reversed from that 7 degrees to 7 degrees from vertical the other way for a given distance, after which the top surface of the "hump" is smoothly "radiused" around.

5 Claims, 3 Drawing Sheets

Fig. 1
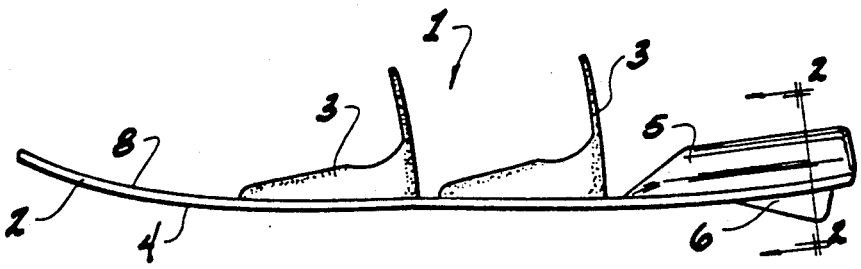
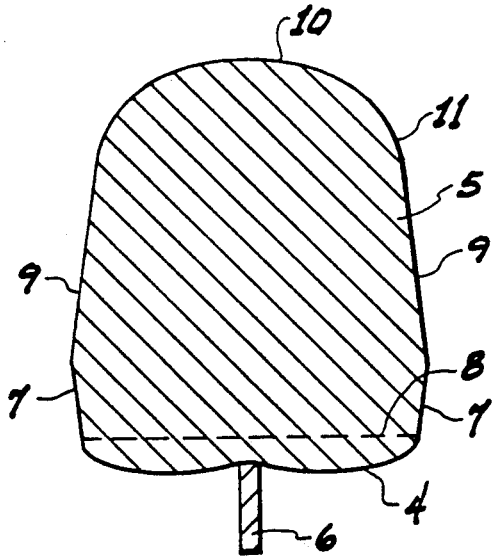
Fig. 2
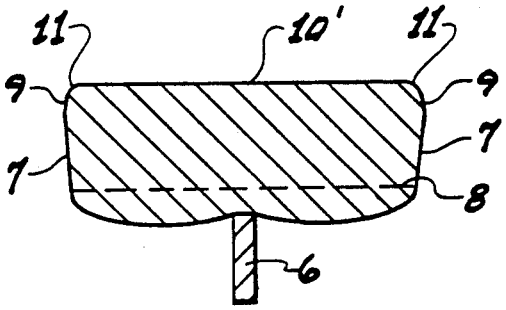
Fig. 2a

Fig. 3
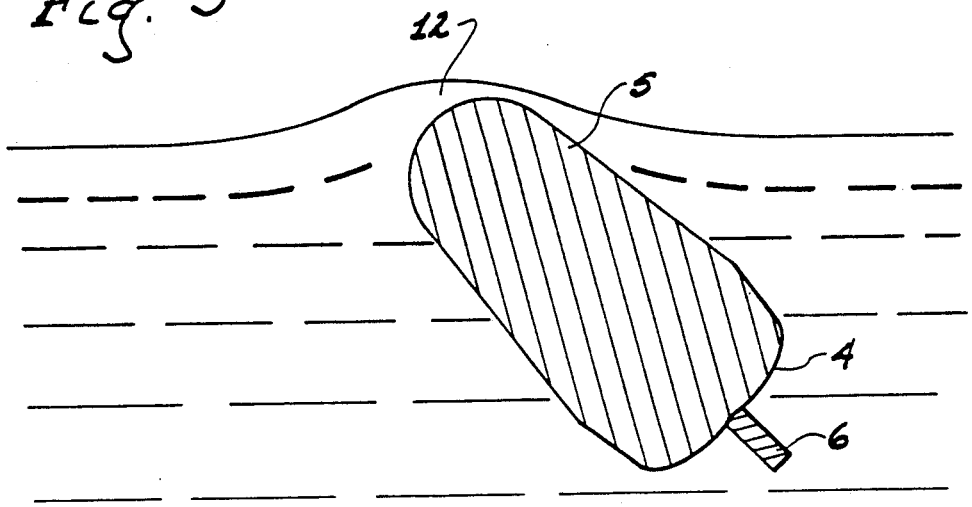
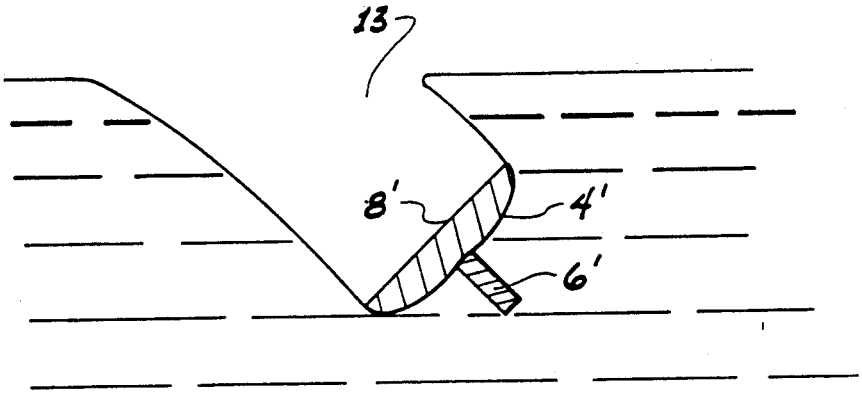
Fig. 4

SLALOM WATER SKI

BACKGROUND OF THE INVENTION

1. Field of the Invention

This invention relates to a novel water ski design especially adapted for competition in slalom water ski events.

2. Description of Related Art

A search was carried out in the United States Patent Office for patents which might teach ski designs similar to or anticipatory of the ski of this invention. None were found. The patents which were found and/or selected as possibly pertinent are as follows:

| U.S. Pat. No. | Inventor | Date | Title |
|---|---|---|---|
| 3,066,327 | D. L. Durfey | 12/4/62 | Retractable Stabilizer for Water Skis |
| 3,655,211 | J. Bollettieri | 4/11/72 | Double Bend Stave |
| 4,262,927 | P. Hochstrasser | 4/21/81 | Streamlined Tip for a Ski |
| 4,697,821 | K. Hayashi et al | 10/6/87 | Ski |

The teachings of these patents and how they compare with the present invention are discussed briefly in an attachment to the enclosed Information Disclosure Citation Form.

SUMMARY OF THE INVENTION

The present invention relates to a novel water ski design which is particularly suitable for competition in slalom water ski events. Basically, in slalom competition, the skier first goes through a straight course through two buoys and then goes around six buoys for a certain distance out from the center. So it's an event that involves a lot of turning; the skier goes out and then turns back; goes out, turns back; goes out, turns back; goes out, turns back, etc in a zig zag fashion.

To better compete in this event, the ski design has been modified by adding a special contour to the top surface of the rear end of the water ski which enables the ski to utilize the water flow and surface tension of the water to cause the ski to turn in a very controlled manner and to complete the turn and transistion to pull phase of the racing action in a superior manner.

The standard design of skis used in slalom competition has a flat top surface over the rear one-third of the ski and has a slope of about 7 degrees downward from the top. In other words, the ski is slightly wider at the top than it is on its underside bottom. The modification design of the present invention relates to adding what may be referred to as a "hump" or "hummock" on the rear one-third of the ski. The sides of the hump coincide with the sides of the rear of the ski. In this "hump" the seven degree angle from vertical continues upwardly for a given distance above the normal top surface of the ski and is then reversed from that 7 degrees to 7 degrees from vertical the other way for a given distance, after which the top surface of the "hump" is smoothly "radiused" around, as hereinafter more fully described by reference to the drawings. The "radius" or curvature at the back of the "hump" just matches the contour of the back end of the ski so that the water can smoothly flow around it and not develop a high pressure area.

The teachings of none of the patents cited above have the physical attributes of the rear one-third of the skis of same as has just been described as being possessed by the skis of the present invention. A clearer understanding of the present invention will be facilitated by reference to the drawings.

BRIEF DESCRIPTION OF THE DRAWINGS

FIG. 1 is a side view of the ski with the rear section of same modified with a hump according to the invention.

FIG. 2 is a vertical cross-sectional view taken across line 2—2 of the ski of FIG. 1.

FIG. 2*a* is similar to FIG. 2 but with a differently modified hump area. The hump has a lower profile with substantially a flat top.

FIG. 3 is a cross-sectional view through the rear portion of the ski of FIG. 2 of the present invention illustrating the ski's performance in water during a turn.

FIG. 4 is a view corresponding to FIG. 3 but showing the performance of a conventional slalom ski in water during a turn.

DETAILED DESCRIPTION OF THE DRAWINGS AND OF THE PREFERRED EMBODIMENTS

Referring now to the foregoing figures in more detail, the entire ski is designated by the numeral 1 in FIG. 1. The curvature at the front of the ski is illustrated at 2; with boots which the skier fits his feet into at 3; the ski bottom at 4; the modifications introduced by the present invention (which may be referred to as a "humper" or "hump" or "hummock" at 5; the keel of the ski at 6; and the top surface of the ski at 8.

With reference now to other figures, all of which pertain to the rear portion of the ski, the top surface of a typical ski slat is designated by the numeral 8' (FIG. 4) (or as shown by the dotted lines in FIGS. 2 and 2*a*). In such a typical ski, the underside of the ski slopes inwardly from vertical toward the bottom of the ski with a 7 degree taper. With the modified skis of the present invention this 7° taper continues in the same direction above the normal top surface 8' of the ski and then reverses to 7 degrees from vertical in the opposite direction at 9 (FIGS. 2, 2*a*, 5 and 5*a*) after which the top of the hump or humper is smoothly "radiused" around at 11 to a convex surface 10 as illustrated in FIG. 2 or to a flat top surface 10' as illustrated in FIG. 2*a*.

It is important to note that the angular taper variations and "radiusing" around as just described are very important to the performance of the ski and to the safety of the user of the ski. By the term "radiusing" is meant a smoothly curved transition from the sides of the humper of the ski to its top so as to avoid sharp edges which would adversly affect desired water flow over the top of the hump and which angular features could also be dangerous to the skier or those near him in case of a mishap during performance.

When sking with the modified ski of the present invention, on abrupt turns which are required in slalom competition, the water is displaced smoothly over the rear portion of the ski during a turn as illustrated in FIG. 3; whereas, and as illustrated in FIG. 4, this is not the case of what occurs during normal performance of a conventional ski. In such latter instance, instead of the water going over the top of the rear portion of the ski, the water is displaced by the rear portion of the ski, creating a low pressure open area above the top surface of the rear portion of the ski resulting in conditions making quick abrupt turns difficult and rough.

Figure 5:
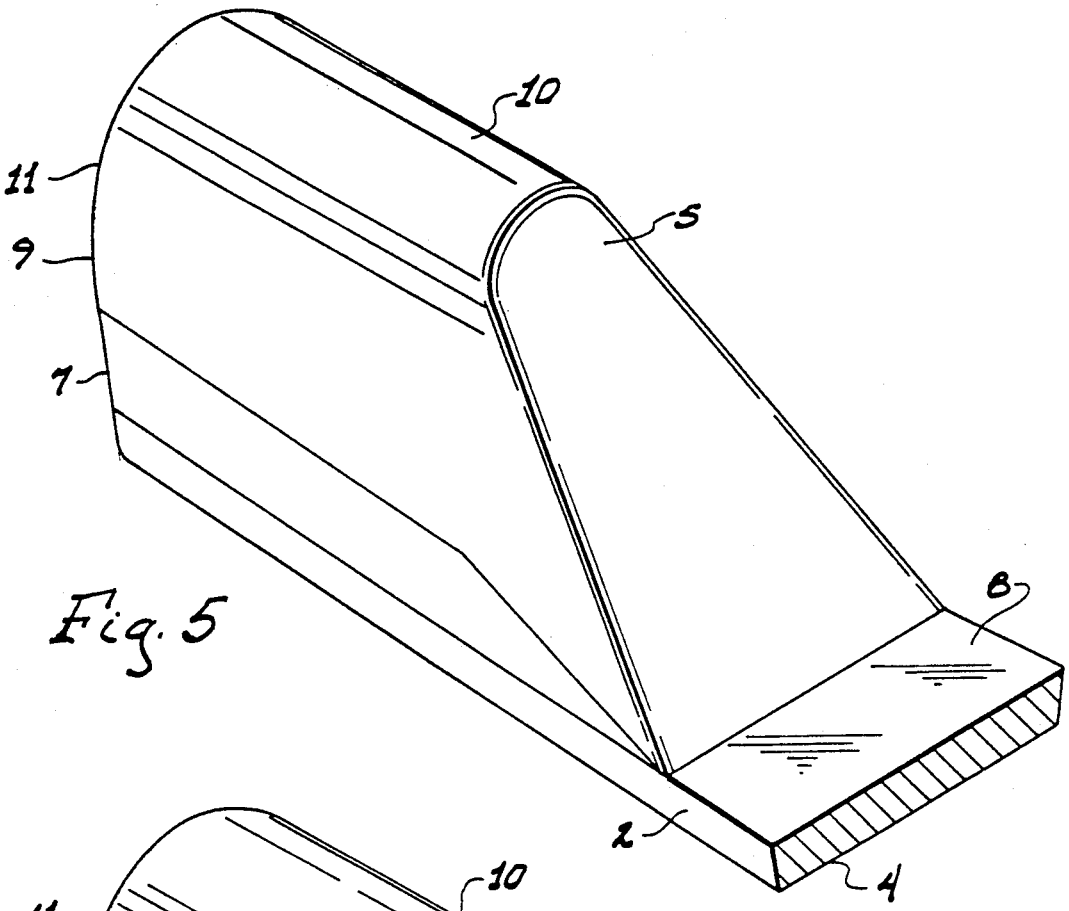
FIG. 5 is a perspective view of the rear area of the ski of the present invention (looking toward the rear end of the ski) wherein a conventional ski has been modified by the addition of a hump to the rear portion of same.
Figure 5A:
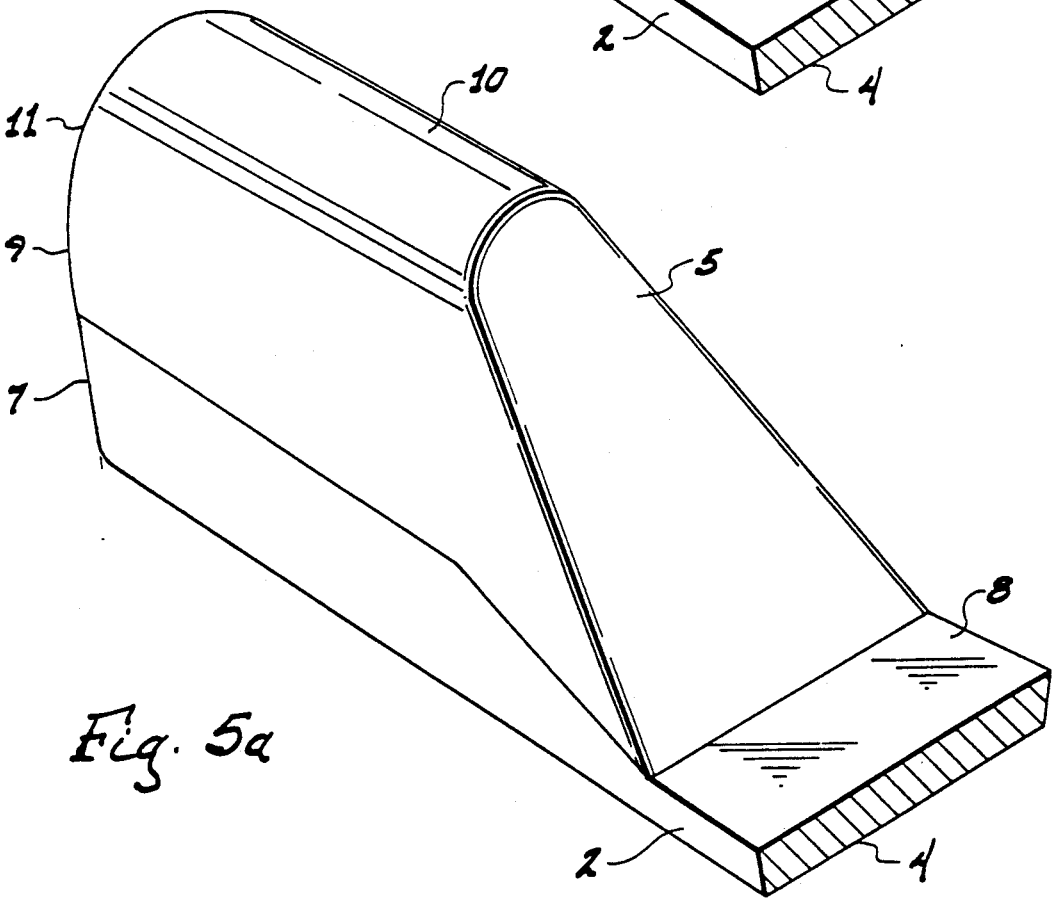
FIG. 5*a* is similar to FIG. 5 in that it illustrates a ski utilizing the present invention but wherein the hump in the rear portion of same is an integral part of the ski as manufactured rather than an add-on piece to a ski previously manufactured.

Because there are many different types and designs of slalom water skis presently on the market, it would be difficult to design a humper for the rear portion of the ski which would fit every ski design; thus, for each slalom water ski presently on the market, a humper varying in design in some respects might be required for each particular ski as to exact dimensions and curvatures etc., that would lead to optimum performance for each particular ski. In the case of the present invention several humpers have been designed for one particular ski; and each humper, falling within specified requirements and dimensions as hereinafter described have led to satisfactory and improved performance in slalom competition as compared to the ski without the humper modifications added thereto. This alternative variation of the present invention is as illustrated in FIG. 5. However, for best results and economy of fabrication it is preferred that the ski be manufactured with a humper of the present invention incorporated as a part of the ski and integral therewith during its manufacture rather than separately manufactured for the purpose of being added to previously manufactured skis not possessing the humper feature of the present invention.

To modify a ski presently on the market to add a "hump" according to the present invention, a substantially rectangular shaped insert was added to the rear portion of the ski centrally located on the top surface over the rear 10 inches or so of the ski. The insert was about ¼ to ⅜" thick and was so fashioned as to accommodate recesses (having the same dimensions as the inserts) in the bottom of the humps to be tested. When the humps were thus securely attached to the top surface of the rear portion of the ski, such as by means of screws, the bottom surfaces of the humps interfaced with the top surface of the ski very smoothly all along the matched surfaces and all along the sides of the ski and the rear portion as well.

Humps having the following dimensions are representative of those within the present invention that can bring about improved performance in slalom competition.

It should be pointed out that all of these humps are characterized by having shapes with the 7° angular taper features and the "radiusing around" transition feature toward the top surface thereof as previously discussed. They also are characterized by the fact that their side and end portions coincide with the sides and end portions of the skis to which they are to be connected. They also are characterized by having front ends that smoothly lead into the remaining portions of the humps so as to minimize water turbulence when this portion of the hump comes in contact with the water during the slalom competition.

As previously mentioned, however, it is preferable that the ski and the hump be manufactured as an integral unit, rather than the hump be separately manufactured and designed as for an add-on to an existing ski. Both variations are considered within the invention, however.

It should also be mentioned that the density of the material of the humps and/or of the skis to which they are attached should be less than 1.0 so that they are capable of floating in water and also so that the overall weight and center of balance of the ski are not greatly affected; otherwise, the skier's performance could be adversely affected. A factor in ski design is the flex. The flex is a compromise in ski design to achieve both turning ability and acceleration. A softer flex provides turning ability; a stiffer flex provides acceleration. What the hump does is to give the ski a stiffer flex to provide better acceleration without compromising turning ability. The dimensions of hump "E" are considered near maximum in order to comply with meeting performance requirements and/or goals as just discussed and as are sought to be achieved by this invention without introducing extraneously concomitant adverse features to the ski, such as undesirable shifting of the center of balance for the ski. It should also be stated that the addition of the hump meets all present American Water Ski Association rulebook specifications for slalom competition.

Having thus described the invention, it should be apparent that numerous structural modifications and adaptations may be resorted to without departing from the scope and fair meaning of the instant application as described here and above and as claimed here and below.

I claim:

1. A water ski especially suited for slalom competition, said ski being characterized by possessing a hump

| | Humper A | Humper B | Humper C | Humper D | Humper E | Humper F | Humper G | Humper H |
|---|---|---|---|---|---|---|---|---|
| Width of Humper at its front end | 4¾" | 4¾" | 4¾" | 4¾" | 4¾" | 4¾" | 4¾" | 4¾" |
| Width of bottom of humper at its rear end | 2½" | 2½" | 2½" | 2½" | 2½" | 2½" | 2½" | 2½" |
| Height of humper at its* front end | ¼" | ⅛" | ⅛" | ¼" | ⅛" | ¼" | ¼" | ¼" |
| Height of humper at its rear end | 2½" | ¾" | 1½" | 2¾" | 4" | ¾" | 1⅜" | 4" |
| Height of Humper near its mid-length | 2½" | ¾" | 1½" | 2½" | 4" | ¾" | 1⅜" | 4" |
| Width of top of humper near its mid-length | 3½" | 3¾" | 4" | 3" | 2" | 3¾" | 3¾" | 2½" |
| Width of top of humper at its rear end | 2¼" | 2½" | 2½" | 1¾" | 1½" | 2⅜" | 2¼" | 1½" |
| "Radiusing Around" Distance at One Side of Top of Humper | ⅛" | ¼" | ⅜" | ⅛" | ⅛" | ¼" | ¼" | ⅛" |

*Height of front of humper ideally should blend in smoothly with top surface of ski.

over the rear one-third of the ski, said hump having angled portions at each side, a radiused portion forming its top and said hump forming the top surface of the rear of the ski, the sides and ends of the hump being smooth in contour with the sides and ends of the ski.

2. A water ski according to claim 1 wherein the angled portions of the sides of the ski are created by extending a 7 degree slope from vertical for a given desired distance and then reversing the 7 degree slope direction to 7 degrees from vertical in the other direction for a given desired distance.

3. A water ski according to claim 1 wherein the ski is of one-piece integral construction as designed and manufactured.

4. A water ski according to claim 1 wherein the ski construction defined is a combination formed from two main elements, the ski itself and a hump which is added to the rear one-third of the ski, said hump having the properties as set forth in said claim.

5. A hump for addition to a water ski suited for slalom competition, said hump being characterized by being about one-third the length of the ski, the sides and ends of the hump being smooth in contour with the sides and ends of the ski to which the hump is to be added, the sides of the hump extending from its base by a 7° taper in an increasing cross-sectional area direction, and then the sides of the hump reversing to a 7° slope direction from vertical in a decreasing cross-sectional area direction for a given distance and then smoothly radiusing around to the top surface of the hump.

* * * * *